US009481957B2

(12) United States Patent
Schulze

(10) Patent No.: US 9,481,957 B2
(45) Date of Patent: Nov. 1, 2016

(54) METHOD FOR OPTIMIZING A RINSING PHASE IN A WASHING MACHINE AND WASHING MACHINE SUITABLE THEREFOR

(75) Inventor: Ingo Schulze, Panketal (DE)

(73) Assignee: BSH HAUSGERÄTE GMBH, Munich (DE)

( * ) Notice: Subject to any disclaimer, the term of this patent is extended or adjusted under 35 U.S.C. 154(b) by 1137 days.

(21) Appl. No.: 13/256,654

(22) PCT Filed: Mar. 9, 2010

(86) PCT No.: PCT/EP2010/052944

§ 371 (c)(1),
(2), (4) Date: Sep. 23, 2011

(87) PCT Pub. No.: WO2010/105937

PCT Pub. Date: Sep. 23, 2010

(65) Prior Publication Data

US 2012/0005842 A1 Jan. 12, 2012

(30) Foreign Application Priority Data

Mar. 16, 2009 (DE) ..... 10 2009 001 582

(51) Int. Cl.
*D06F 35/00* (2006.01)

(52) U.S. Cl.
CPC ..... *D06F 35/006* (2013.01); *D06F 2202/02* (2013.01); *D06F 2204/065* (2013.01); *D06F 2232/06* (2013.01)

(58) Field of Classification Search
CPC ..... D06F 35/006
See application file for complete search history.

(56) References Cited

U.S. PATENT DOCUMENTS

2007/0102024 A1 5/2007 Classen

FOREIGN PATENT DOCUMENTS

| | | | | |
|---|---|---|---|---|
| DE | 3907357 A1 | 9/1990 | | |
| DE | 19650915 A1 | 1/1998 | | |
| DE | 10042846 A1 | 5/2002 | | |
| DE | 2007041069 A1 * | 3/2009 | ..... | D06F 35/00 |
| DE | 102007041069 A1 | 3/2009 | | |
| EP | 0383218 B1 | 3/1993 | | |
| EP | 0649933 B1 | 3/1999 | | |

(Continued)

OTHER PUBLICATIONS

English machine translation of DE2007041069A1.*

(Continued)

*Primary Examiner* — Michael Barr
*Assistant Examiner* — Jason Riggleman
(74) *Attorney, Agent, or Firm* — Nixon & Vanderhye, PC.

(57) ABSTRACT

A method for optimizing a rinsing phase in a washing machine includes introducing rinsing liquid in a last step of the rinsing phase into an outer tub of the washing machine. A sensor detects a presence of fabric softener in the rinsing liquid to produce a signal which is compared with a reference signal to determine the presence of fabric softener in the rinsing liquid. Rinsing is executed with water only in the absence of fabric softener, or with water and fabric softener in the presence of fabric softener, with a washing kinetics reduced by at least 15% when rinsing involves water and fabric softener and including a switch-on time, duration of a reversing cycle, and rotational speed of a drum of the outer tub. Switch-on time and rotational speed are hereby each reduced by at least 20% whereas duration of the reversing cycle is increased by at least 20%.

11 Claims, 1 Drawing Sheet

(56) References Cited

FOREIGN PATENT DOCUMENTS

| | | | |
|---|---|---|---|
| EP | 1184505 | A2 | 3/2002 |
| EP | 0837172 | B1 | 4/2003 |
| EP | 0760472 | B1 | 5/2004 |

OTHER PUBLICATIONS

International Search Report PCT/EP2010/052944.
Report of Examination DE 10 2009 001 582.5.

* cited by examiner

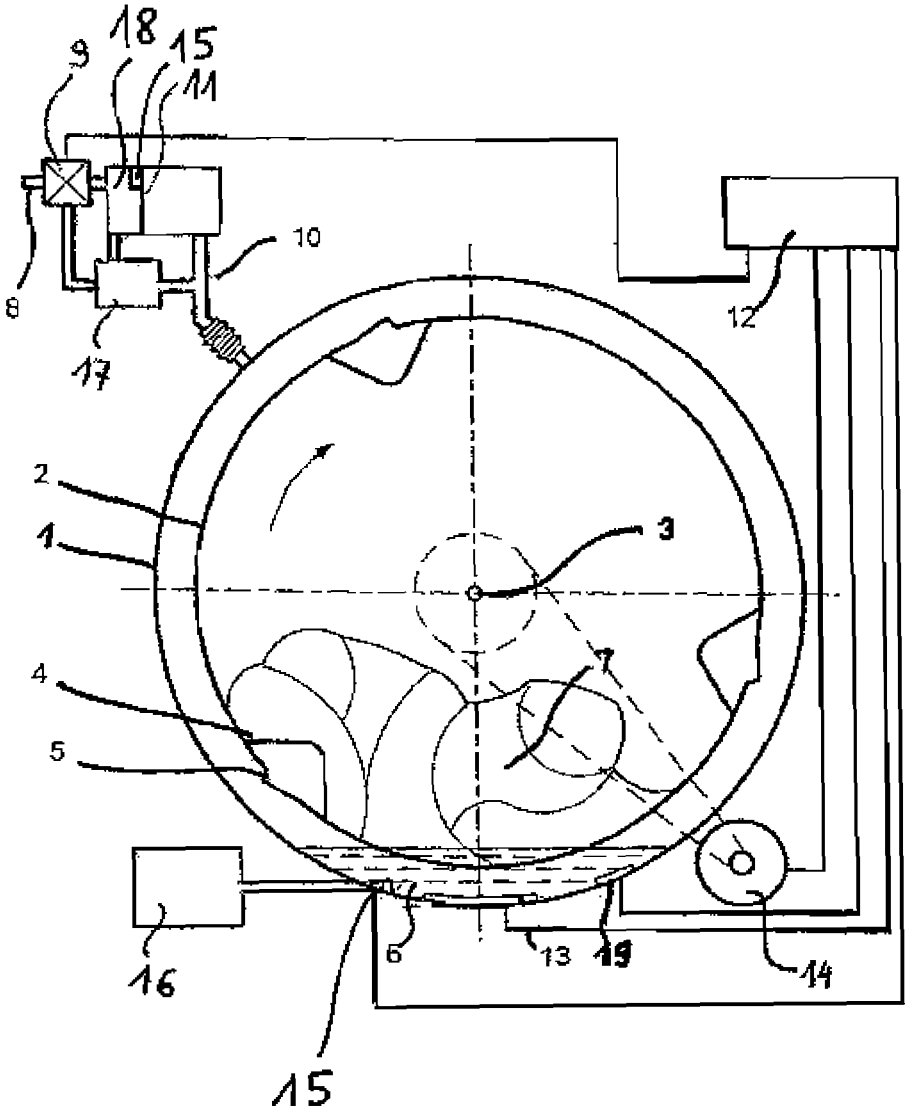
18
15
9
11
10
8
17
12
2
1
3
4
7
5
6
13
19
14
16
15

METHOD FOR OPTIMIZING A RINSING PHASE IN A WASHING MACHINE AND WASHING MACHINE SUITABLE THEREFOR

This application is a U.S. National Phase of International Patent Application No. PCT/EP2010/052944, filed Mar. 9, 2010, which designates the U.S. and claims priority to German Patent Application No. DE 10 2009 001 582.5, filed Mar. 16, 2009, the entire contents of each of which are hereby incorporated by reference.

BACKGROUND OF THE INVENTION

The invention relates to a method for optimizing a rinsing phase in a washing machine comprising a program control system for controlling the sequence of a program, a drum which is rotatably mounted in an outer tub, a water feed system, a dispensing drawer, a liquor outlet system arranged at the base of the outer tub with a drain pump, a drive motor for the drum and a sensor for the presence of fabric softener in a rinsing liquid situated in the outer tub, wherein the rinsing phase comprises at least one first step and one last step, and also relates to a washing machine which is particularly suitable for carrying out said method.

It is known to detect contaminants or particles and washing agent dissolving processes by means of an optical sensor in a washing machine.

DE 196 50 915 B4 discloses a domestic appliance operating with liquid and having a program control system and a conductance sensor by means of which the conductance of a liquid situated in the active region of the domestic appliance can be determined, wherein using the results from the conductance measurement, a cleaning substance contained in the liquid can be identified and, depending on the conductance detected and the cleaner type identified, a predefined program is carried out.

EP 0 649 933 B1 discloses a washing machine with controlled washing agent usage and a control method. The washing machine includes means for detecting the washing agent concentration in the washing liquid and means for estimating the optimum washing agent concentration and means which display to the user the results of the comparison of the washing agent concentration detected with the estimated optimum washing agent concentration.

DE 103 47 766 A1 discloses a domestic appliance which is able to carry out a cleaning procedure using cleaning liquid, having a system for feeding cleaning agent into the cleaning liquid. A sensor determines the content of active washing substances in the cleaning liquid during the cleaning procedure. A dosing system is also present which, if the content of active washing substances is too low, feeds additional cleaning agent or, if the content of active washing substances is too high, feeds fresh water into the cleaning liquid. Preferably, the sensor is a surfactant sensor which determines the surfactant content in the cleaning fluid by means of a bubble pressure method.

From DE 195 29 787 A1 a method for fill level-independent determination of the surface tension of liquid substances is known which is preferably suitable for determining and influencing the quality of liquors during washing and/or rinsing of soiled or clean textile goods. For this purpose, a gaseous stream is fed into the liquid to be measured and the bubble pressure and/or the flow rate is measured and evaluated during bubble bursting.

DE 100 42 846 A1 discloses a method for qualitative and/or quantitative characterization of polar components in liquids by impedance measurement and the use of the method and possibly an electrode arrangement for controlling the surfactant feed based on the characterization of the surfactant content in the washing water and/or rinsing water of washing machines.

DE 10 2007 041 069 A1 describes a method for recognizing fabric softener in a washing machine with program control for controlling a program sequence, a drum which is rotatably mounted in an outer tub, a water feed system, a liquor outlet system arranged at the base of the outer tub with a drain pump, a drive motor for the drum and a sensor, wherein in a washing procedure, following a washing or rinsing step, particularly following a rinsing step with clean water, a signal is detected from the sensor and is evaluated by comparison with a reference signal with respect to the presence of fabric softener. Depending on the quantity of fabric softener detected, the duration of the softening step and/or further subsequent rinsing steps, the temperature of the rinsing liquid, the rotational speed of the drum etc. can be determined.

DE 3907357 discloses a method for rinsing washing in a program-controlled drum washing machine in a plurality of sequential rinsing operations, wherein the last rinsing operation is performed with an increased rinsing water quantity compared with the preceding rinsing operations and the increased rinsing water quantity is let in for the last rinsing operation only if a fabric softener is used.

EP 1 184 505 A2 discloses a method for controlling a washing program in a washing machine, in particular a domestic washing machine, comprising a measuring device for determining the washing agent concentration of the washing liquor or rinsing liquor situated in an outer tub, wherein the washing program comprises at least the program sections of washing and rinsing. A control device stores the washing agent concentration values detected in the washing program section and determines, depending thereon, the sequence of the rinsing program section with respect to the number and/or duration of individual rinsing operations and/or the rinsing water quantity fed into the outer tub.

A washing program usually involves, following the actual washing step and at least one rinsing step in which only water is used as the rinsing liquid to rinse out any remaining washing agent, at the wish of the user, a rinse with a fabric softener. The dosing of fabric softener into the liquid is usually carried out by adding an empirical or prescribed quantity of fabric softener. For the calculation of an optimum concentration of fabric softener, the dependence thereof on a plurality of factors such as the temperature and the hardness of the water as well as the type and quantity of the washing need to be taken into account. The duration of the fabric softener rinse also depends on the quantity of fabric softener used.

An object of the present invention is therefore to provide a method for further improving a rinsing phase in a program-controlled washing machine and a programmable washing machine that is suitable therefor.

This object is achieved according to the invention with a method for optimizing a rinsing phase in a washing machine having the features of the corresponding independent claim and the washing machine of the corresponding independent claim. Preferred embodiments of the method according to the invention and of the washing machine according to the invention are disclosed in corresponding dependent claims. Preferred embodiments of the method according to the invention correspond to preferred embodiments of the washing machine according to the invention and vice versa, even if not explicitly stated herein.

The subject matter of the invention is therefore a method for optimizing a rinsing phase in a washing machine comprising program control for controlling a program sequence, a drum which is rotatably mounted in an outer tub, a water feed system, a dispensing drawer, a liquor outlet system arranged at the base of the outer tub with a drain pump, a drive motor for the drum and a sensor for the presence of fabric softener in a rinsing liquid situated in the outer tub, wherein the rinsing phase comprises at least one first step and one last step, and in which method in the last step, alternatively a rinsing step with water only and a rinsing step with water and fabric softener are provided, that in the last step, a rinsing liquid is let into the outer tub and a signal from the sensor is detected, said signal is evaluated by comparison with a reference signal $S_{Ref}$ with respect to the presence of fabric softener in the rinsing liquid, that if the presence of fabric softener is not detected, the rinsing step with water only takes place, that if the presence of fabric softener is detected, the rinsing step with water and fabric softener takes place, and that in the rinsing step with water and fabric softener, compared with the rinsing step with water only, a washing kinetics is understood to mean the input of mechanical energy into the washing items to be treated in the drum, and the washing kinetics $W_M^1$ is reduced by at least 15%, wherein the washing kinetics $W_M$ comprises a switch-on time [in %], a duration of a reversing cycle [in s] and a rotational speed [in rpm] of the drum, wherein the switch-on time [%] and the rotational speed [rpm] of the drum are each reduced by at least 20% and the duration of a reversing cycle [s] is increased by at least 20%.

The washing kinetics is generally understood to mean the input of mechanical energy into the washing items to be treated in the drum, particularly the items to be washed or rinsed. According to the invention, the washing kinetics $W_M$ comprises a switch-on time [in %], a duration of a reversing cycle [in s] and a rotational speed [in rpm] of the drum. If the presence of fabric softener is detected, the switch-on time [in %] and the rotational speed [in rpm] of the drum are each reduced by at least 20%, preferably by at least 50% and the duration of a reversing cycle [in s] is increased compared with the first clean water rinsing step by at least 20%, preferably by at least 50%.

BRIEF SUMMARY OF THE INVENTION

The switch-on time is the temporal proportion of the rinsing phase during which the drum rotates. This switch-on time preferably amounts, in the first clean water rinsing step, to 60% to 70%. Where the presence of fabric conditioner is detected, according to the invention, the switch-on time is reduced by at least 20% in a preferred embodiment. This corresponds in this preferred example to a switch-on time of not more than 48% to 56%.

A reversing cycle is, in general, the time period given by the following time segments: rotation of the drum in one direction, resting of the drum, rotation of the drum in the opposite direction, resting of the drum. In the first clean water rinsing step, a reversing cycle preferably has a duration of 30 s to 50 s. If the presence of fabric softener is detected, then according to the invention, a reversing cycle would be increased by at least 20%. This corresponds in this preferred example to a switch-on time of at least 36% to 60%.

According to the invention, it is therefore provided that for the last step of the rinsing phase, two alternative, mutually different rinsing steps are provided, of which one is provided specifically for the absence of fabric softener and the other specifically for the presence of fabric softener. In this way, an optimized rinsing step can be offered for rinsing the washing items without a fabric softener, while at the same time, an optimized rinsing step is offered for achieving the best possible effect of the fabric softener used.

The expression "rinsing liquid" used here denotes the liquid that is provided for a rinsing step in the outer tub. This rinsing liquid generally contains components of the washing liquor used in preceding process steps and which are extracted from the washing items during the rinsing step. In the last rinsing step, said rinsing liquid can also contain a fabric softener.

In preferred embodiments of the invention, if the presence of fabric softener is detected, the water can be heated and/or more water can be added, in order to achieve improved removal of the surfactants of the fabric softener.

In a preferred embodiment of the method according to the invention, in the rinsing phase, a plurality of first steps is provided in order to free the washing as well as possible from residues of the washing liquor.

The presence of fabric softener in a rinsing liquid is determined by a suitable sensor. As the sensor for determining the quantity of a fabric conditioner present in the outer tub, the signal from which can be tracked during the method according to the invention, an optical sensor, a tensiometer or a conductivity sensor is preferably used.

An optical sensor measures optical properties of the rinsing liquid which differ for water and for water containing fabric softener. Accordingly, the presence of fabric softener in a rinsing liquid can be determined qualitatively and quantitatively.

A tensiometer is a simple dynamic measuring system for determining the fabric softener content in the rinsing liquid. By means of the tensiometer, using the 'bubble pressure'method, a signal that is proportional to the surface tension of the liquid, which corresponds to the concentration of fabric softener, is obtained. A tensiometer operating using the bubble pressure method (bubble tensiometer) has at least one capillary which is fed into the washing liquid and from which a predefined gas stream escapes into the liquid at a defined capillary pressure, forming bubbles. The gas used for this is, for example, air. Fabric softener contained in the liquid collects at the surface of a bubble formed by means of a measuring capillary and thereby reduces the surface tension of the bubble. The greater the concentration of fabric softener, the lower is the surface tension of the bubble.

A conductivity sensor usually detects two electrodes which are arranged in the liquid to be investigated, said electrodes enabling an assessment to be made of the qualitative and quantitative presence of fabric conditioner by means of a conductivity measured therebetween.

Particularly preferably, an optical sensor or a conductivity sensor is used.

In a preferred embodiment of the method according to the invention, the reference signal for the sensor is obtained by measuring the corresponding signal for water from a previous filling with water with the aid of said sensor. In particular, water fillings from previous rinsing steps, from recent water fillings via adjacent chambers, e.g. a prewash chamber, or water fillings in previous wash programs/process steps can be used for determining the reference signal.

In a further preferred embodiment, the reference signal is stored in the program control system of the washing machine. In this event, the evaluation is carried out in respect of the presence of fabric conditioner in a rinsing liquid by means of a comparison of the signal measured at the sensor with the reference signal stored in the program control system.

In general, in the method according to the invention, at least the signal of a rinsing liquid let into the outer tub after the first clean water rinse is measured by the sensor.

The expression "evaluation in respect of the presence of fabric softener" implies an evaluation in respect of the qualitative and possibly quantitative presence of fabric softener. Depending on the requirements, it may be sufficient in the method according to the invention that the presence of fabric softener is qualitatively determined.

In a preferred embodiment, depending on the result of the evaluation in respect of the presence of fabric softener, if the fabric softener concentration is too low, fabric softener is fed in by a dosing device for the fabric softener in the washing machine and, if the fabric softener concentration is too high, water is fed in via the water feed system. Preferably, a quantitative determination of the fabric softener is carried out by means of the sensor.

For a quantitative determination of the concentration or quantity of fabric softener, data possibly stored in a memory of the program control system concerning the connection between the type and concentration of the fabric softener and the respective signal (e.g. conductivity, surface tension, optical characteristics) can be called upon.

Preferably, a result of the evaluation with respect to the presence of fabric softener is output in the form of an optical and/or acoustic signal.

A "result of the evaluation" in the context of the present invention can involve the simple recognition that fabric softener is present or is not present. Furthermore, it could also be the determination of the fact or the extent of an excessively high or excessively low concentration of fabric softener.

Accordingly, the fabric softener content determined by the sensor during the method according to the invention can be output via suitable optical and/or acoustic output means, so that an operator can independently undertake the addition of fabric softener during operation of the washing machine, based on the displayed concentration value.

For example, an acoustic signal output, such as one or more buzzers having different sounds or tones or a speech synthesizer with messages such as "fabric softener absent" or "too little fabric softener" or "fabric softener correct" could be used. Corresponding qualitative and quantitative information on the presence of fabric softener in the rinsing liquid can be output via optical display devices such as LED or LCD display devices.

Regardless of whether a qualitative or quantitative evaluation takes place with respect to the presence of fabric softener, according to the invention, the rinsing phase is adjusted to a result of the evaluation with respect to the presence of fabric softener. In particular, when the presence of fabric softener has been detected, a fabric softening step is carried out in which the washing kinetics $W_M^1$ are reduced as described in detail above. In this respect, account is taken of a quantity of fabric softener determined by the sensor with respect to the duration of the fabric softening phase, the temperature of the rinsing liquid, the rotational speed of the drum, etc.

If the absence of fabric softener is determined, a second clean water rinsing step can be carried out.

A further object of the invention is a washing machine comprising a program control system for controlling a program sequence, a drum which is rotatably mounted in an outer tub, a water feed system, a dispensing drawer, a liquor outlet system arranged at the base of the outer tub with a drain pump, a drive motor for the drum and a sensor for the presence of the fabric softener in a rinsing liquid situated in the outer tub, wherein the program control system is configured to optimize a rinsing phase, wherein the rinsing phase comprises at least one first step and one last step; in said washing machine, the program control system is configured to carry out the rinsing phase in such a way that in the last step, alternatively a rinsing step with water only and a rinsing step with water and fabric softener are provided, that in the last step, a rinsing liquid is let into the outer tub and a signal from the sensor is detected, said signal is evaluated by comparison with a reference signal $S_{Ref}$ with respect to the presence of fabric softener in the rinsing liquid, that if the presence of fabric softener is not detected, the rinsing step with water only takes place, that if the presence of fabric softener is detected, the rinsing step with water and fabric softener takes place, and that in the rinsing step with water and fabric softener, compared with the rinsing step with water only, a washing kinetics $W_M^1$ is reduced by at least 15%, wherein the washing kinetics is understood to mean the input of mechanical energy into the washing items to be treated in the drum, and the washing kinetics $W_M$ comprises a switch-on time [in %], a duration of a reversing cycle [in s] and a rotational speed [in rpm] of the drum, wherein the switch-on time [%] and the rotational speed [rpm] of the drum are each reduced by at least 20% and the duration of a reversing cycle [s] is increased by at least 20%.

Particular properties and advantages of said washing machine are disclosed in the above statements concerning the method according to the invention, to which reference will now be made.

In a washing machine according to the invention, an optical sensor, a tensiometer or a conductivity sensor is preferably used as the sensor.

In a preferred embodiment, the washing machine comprises a dosing device for the fabric softener. If the fabric softener content in the rinsing liquid is too low, the dosing device for the fabric softener can feed in fabric softener. Otherwise, if the fabric softener content in the liquid is too high, the sensor can cause water to be fed in additionally.

During the rinsing procedure, the preferably automatically functioning dosing device advantageously releases to the rinsing liquid only the concentration of fabric softener required, based on the concentration determined by the sensor.

In a preferred embodiment of the invention, the washing machine comprises means for determining an optimum quantity of fabric softener, depending on the type and quantity of the loading with washing and/or the properties of the water used (e.g. hardness, temperature). In this way, the washing machine can determine and control the quantity of fabric softener required in the rinsing liquid for an optimum fabric softening effect.

The load quantity can be determined by a per se known measure. In order to determine the load quantity, for example, a hydrostatic pressure p measured with the aid of a second sensor can be compared with the water quantity let in. The washing situated in the drum draws in water which therefore cannot contribute to an increase in the hydrostatic pressure. The washload (load quantity) can be determined by a comparison of the measured hydrostatic pressure and the water quantity fed in—the absolute values and the changes thereof over time—with corresponding values for the wetting of washing items stored in the program control system of the washing machine. As a result, the duration of the fabric softening phase can be very precisely matched to the existing washload.

The evaluation of the signals supplied by the sensor and the assessment of the fabric softener content in the rinsing liquid and a resulting control of the supply of fabric softener and/or water are preferably undertaken by an electronic control system of the washing machine.

However, the optimum quantity of fabric softener can be known approximately on the basis of empirical data and stored in the memory of the washing machine. The water quantity and the quantity of fabric softener can then be predetermined in a fabric softening program.

The invention has numerous advantages. The method according to the invention has the advantage that, in a rinsing phase, fabric softener can be detected qualitatively and quantitatively in a rinsing liquid and then a fabric softening phase can be optimized. In this way, the application of the fabric conditioner can be carried out better and more economically. The advantages of the sensory system can also be demonstrated to the user of the washing machine in a clearly understandable manner.

DETAILED DESCRIPTION OF EXEMPLARY EMBODIMENTS OF THE PRESENT INVENTION

The invention will now be described in greater detail making reference to FIG. 1.

FIG. 1 shows a schematic representation of the present relevant parts of a washing machine in which a method according to the invention can be carried out. Other embodiments are conceivable. The washing machine in the embodiment shown in FIG. 1 comprises an outer tub 1 in which a drum 2 is rotatably mounted and can be driven by a drive motor 14. For ergonomic reasons, the rotational axis 3 of the drum 2 is oriented by a small angle (e.g. 13°) out of the horizontal upwardly toward the front, so that easier access and a better view into the interior of the drum 2 are provided. Due to this arrangement, in conjunction with specially formed washing agitators 4 and scooping devices 5 for the washing liquor 6 at the inner surface of the drum jacket, intensification of the wetting of the washing 7 with washing liquor is achieved. Arranged in the outer tub 1 is a sensor 15 for detecting the presence of fabric softener.

The washing machine also has a liquor feed system which comprises a water connection fitting for the domestic water supply 8, an electrically controllable valve 9 and a feed line 10 to the outer tub 1, which is fed via a dispensing drawer 11 from which the feed water can transport portions of washing agent into the outer tub 1. The dispensing drawer 11 has a dedicated fabric softener compartment 18 in which there is also a sensor 15 arranged for the presence of fabric softener.

A dosing device 17 enables the feeding, in cooperation with the domestic water supply 8, of fabric softener into the outer tub 1. Also arranged in the outer tub 1 is a heating device 13. The valve 9 and the heating device 13 can be controlled by a control system ("program control system") 12 depending on a program sequence plan, which can be linked to a time program and/or to the achievement of certain measured values of parameters such as liquor level, liquor temperature, rotational speed of the drum 2, etc., within the washing machine. 19 signifies a sensor for measuring the hydrostatic pressure p in the outer tub 1. 16 signifies a pump for the liquid situated in the outer tub 1.

The invention claimed is:

1. A method for optimizing a rinsing phase in a washing machine, said method comprising:

introducing a rinsing liquid into an outer tub of the washing machine;

activating a sensor arranged and configured to be in contact with the rinsing liquid in the outer tub of the washing machine;

executing a program control system configured to:

evaluate a composition of the rinsing liquid in the outer tub of the washing machine using the sensor;

determine an amount of fabric softener present in the rinsing liquid by comparing the composition of the rinsing liquid with a reference signal;

assign a value to the amount of fabric softener detected in the rinsing liquid;

execute a primary rinsing phase in response to the value being below a predetermined level and execute a secondary rinsing phase in response to the value being above the predetermined level;

wherein execution of the secondary rinsing phase causes the washing machine to reduce washing kinetics relating to an input of mechanical energy into washing items to be treated in a drum of the outer tub by at least 15% relative to the primary rinsing phase, with the washing kinetics comprising a switch-on time, a duration of a reversing cycle, and a rotational speed of the drum, wherein the switch-on time and the rotational speed of the drum are each reduced by at least 20% and the duration of a reversing cycle is increased by at least 20%.

2. The method as claimed in claim 1, wherein the reference signal is obtained from the sensor by measuring a signal from water from an upstream water inlet.

3. The method as claimed in claim 1, wherein the reference signal is stored in a program control system for controlling a program sequence.

4. The method as claimed in claim 1, further comprising measuring by the sensor a signal of rinsing liquid introduced into the outer tub after a clean water rinse.

5. The method as claimed in claim 1, further comprising outputting an optical and/or acoustic signal to indicate the presence of fabric softener.

6. The method as claimed in claim 1, further comprising feeding fabric softener from a dosing device for the fabric softener when the evaluating step results in a determination that a fabric softener concentration is below a desired amount, and feeding water via a water feed system of the washing machine when the evaluating step results in a determination that a fabric softener concentration is above the desired amount.

7. A washing machine, comprising:

an outer tub configured to receive a rinsing liquid;

a drum rotatably mounted in the outer tub;

a sensor arranged and configured to be in contact with the rinsing liquid received in the outer tub of the washing machine, the sensor being configured to detect a presence of fabric softener in the rinsing liquid in the outer tub; and a program control system configured to:

evaluate a composition of the rinsing liquid in the outer tub of the washing machine, determine an amount of fabric softener present in the rinsing liquid by comparing the composition contacting the sensor with a reference signal to determine an amount of fabric softener in the rinsing liquid, assign a value to the amount of fabric softener detected in the rinsing liquid, and execute a primary rinsing phase in response to the value being below a predetermined level and execute a secondary rinsing phase in response to the value being above the predetermined level;

wherein execution of the secondary rinsing phase causes the program control system to reduce a washing kinetics relating to an input of mechanical energy into washing items to be treated in the drum of the outer tub by at least 15% relative to the primary rinsing phase, with the washing kinetics comprising a switch-on time, a duration of a reversing cycle, and a rotational speed of the drum, wherein the switch-on time and the rotational speed of the drum are each reduced by at least 20% and the duration of a reversing cycle is increased by at least 20%.

8. The washing machine of claim 7, further comprising a dispensing drawer connected to the outer tub, said sensor being arranged in at least one of the dispensing drawer and the outer tub.

9. The washing machine of claim 7, wherein the sensor is a member selected from the group consisting of an optical sensor, a tensiometer, and a conductivity sensor.

10. The washing machine of claim 7, further comprising a dosing device for the fabric softener.

11. The washing machine of claim 7, further comprising a device for determining an optimum quantity of fabric softener in the rinsing liquid in dependence on a type and quantity of a washload.

* * * * *